United States Patent [19]

Dabrowski

[11] Patent Number: 4,881,919

[45] Date of Patent: Nov. 21, 1989

[54] BULK COIN HOPPER

[75] Inventor: Stanley P. Dabrowski, Euclid, Ohio

[73] Assignee: Ardac, Inc., Eastlake, Ohio

[21] Appl. No.: 167,406

[22] Filed: Mar. 14, 1988

[51] Int. Cl.[4] ..... G07D 1/00

[52] U.S. Cl. ..... 453/57; 221/233

[58] Field of Search ..... 453/32, 33, 34, 35, 453/57; 221/167, 168, 169, 182, 233, 234, 237; 222/220

[56] References Cited

U.S. PATENT DOCUMENTS

| | | | |
|---|---|---|---|
| 3,814,296 | 6/1974 | Tschritter | 222/220 |
| 4,441,515 | 4/1984 | Goepner | 453/32 |
| 4,466,453 | 8/1984 | Said et al. | 453/32 X |

FOREIGN PATENT DOCUMENTS

| | | | |
|---|---|---|---|
| 204405 | 12/1986 | European Pat. Off. | 453/57 |

*Primary Examiner*—F. J. Bartuska

*Attorney, Agent, or Firm*—Renner, Kenner, Greive, Bobak, Taylor & Weber

[57] ABSTRACT

A bulk coin hopper has an angled rotating disk positioned at the bottom of a chamber. A circumferential edge of the rotating disk communicates with an exit slot, from which coins are ejected. Overlapping such disk at the opening is a dispensing disk which is adapted for engaging coins carried by the first-named disk and ejecting the same from the slot.

10 Claims, 4 Drawing Sheets

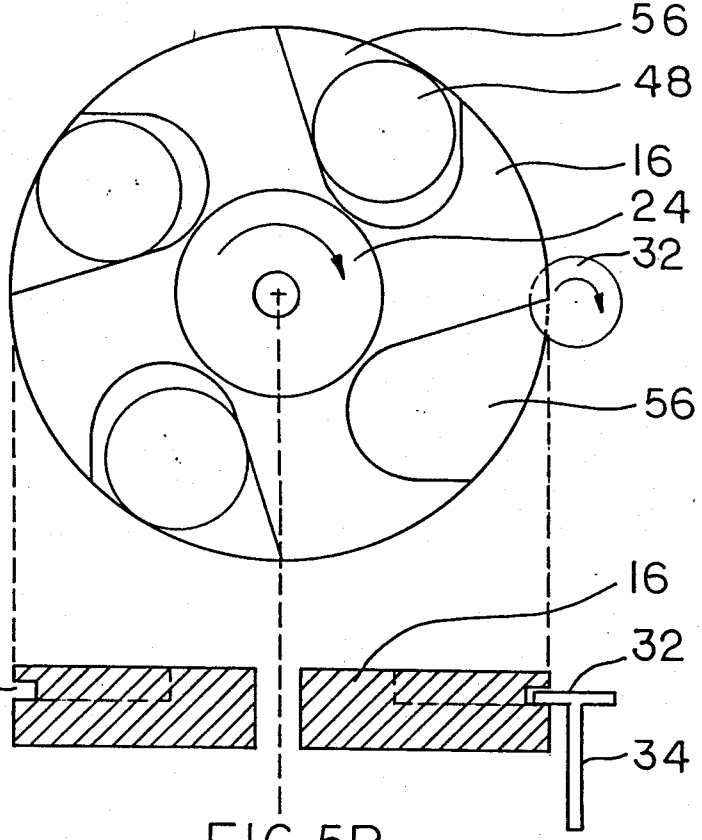
FIG. 5A
FIG. 5B
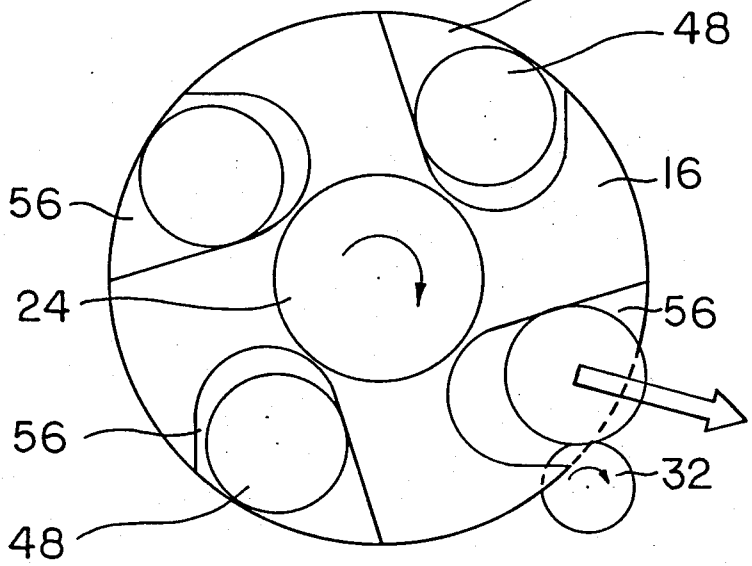
FIG. 4

BULK COIN HOPPER

TECHNICAL FIELD

The invention herein resides in the art of bulk coin or token hoppers. Specifically, the invention relates to a bulk hopper for use in association with a validator, changer, or other equipment requiring the dispensing of coins, tokens, or the like.

BACKGROUND ART

Heretofore, various types of coin or token hoppers have been known and utilized in the changer and dispensing art. A very prevalent type is that known as an indirect pay-out hopper in which coins are loaded into a hold or escrow position from which they are subsequently dispensed when the validity of tendered currency is determined. In such prior art, a belt is often times used to transport coins from a bulk chamber to a chute or channel in which they are maintained until a pay-out is requested. In these systems, two steps for any pay-out are required, the first being the loading of the chute or channel and the second being the actual vending of the coins.

In the prior art, the reloading of the pay-out stack slows down the entire dispensing process. Obviously, there is a limitation on the number of coins that can be placed in each chute or channel, depending upon the length thereof. Such prior art systems do not work well for dispensing coins for changing currency in amounts of five dollars and up. Prior art channels typically hold a maximum of ten coins and, accordingly, to change a five dollar bill to quarters would require an initial dispensing operation, a delay while the channel is reloaded, and a subsequent dispensing operation. The time consumed is aggravated for larger denominations of currency.

Known direct pay-out hoppers have typically incorporated a large rotating disk having protrusions thereon which engaged coions and carried them past a stripper where plural coins were separated from each other and subsequently dispensed by gravity. Such prior systems were tyically slow in operation and required repetitive adjustments and servicing to assure proper operation.

In light of the foregoing, there was found to be a need for a direct pay-out hopper which is rapid and reliable in operation. The need for such a hopper which would accommodate the changing of large bills in short time cycles became apparent. Further, it became apparent that it would be most desirable to dispense the coins directly from a bulk hopper without having to transport the coins to an escrow or hold position first. Accordingly, the only limitation for the number of coins to be dispensed in a single dispensing operation would be the volume of the hopper itself. It further became desirable to provide a direct pay-out changer which would have the capability of not only dispensing coins more rapidly, but of holding more coins in the same physical space as the prior art systems.

DISCLOSURE OF INVENTION

In light of the foregoing, it is a first aspect of the invention to provide a bulk coin hopper which achieves a direct pay-out of coins in response to a vend signal.

Another aspect of the invention is the provision of a bulk coin hopper which is rapidly in operation.

A further aspect of the invention is the provision of a bulk coin hopper which is reliable and durable in operation.

Still an additional aspect of the invention is the provision of a bulk coin hopper which is not susceptible to jamming or misfeeding.

Yet another aspect of the invention is the provision of a bulk coin hopper which can receive and store more coins in the same space as the prior art systems.

The foregoing and other aspects of the invention which will become apparent as the detailed description proceeds are achieved by a bulk hopper for coin dispenser, comprising: a chamber for receiving coins in bulk, said chamber having a bottom; and first plate maintained at said bottom of said chamber, said first plate being selectively adapted for rotation.

Other aspects of the invention are obtained by a hopper for a changer, comprising: a chamber for receiving coins in bulk, said chamber defined by a housing; a first disk maintained in a bottom of said chamber and adapted for selective rotation, said first disk passing in juxtaposition to a slot opening in said housing; and a second disk maintained at said slot opening and rotatable therein.

DESCRIPTION OF DRAWINGS

For a complete understanding of the objects, techniques and structure of the invention reference should be had to the following detailed description and accompanying drawings wherein:

FIG. 4 is a top plan view of the coin rotor and pay-out wheel; and

FIG. 5 comprising FIGS. 5*a* and 5*b*, are respective top plan and side sectional views of the coin rotor assembly of the invention.

BEST MODE FOR CARRYING OUT THE INVENTION

Figure 1:
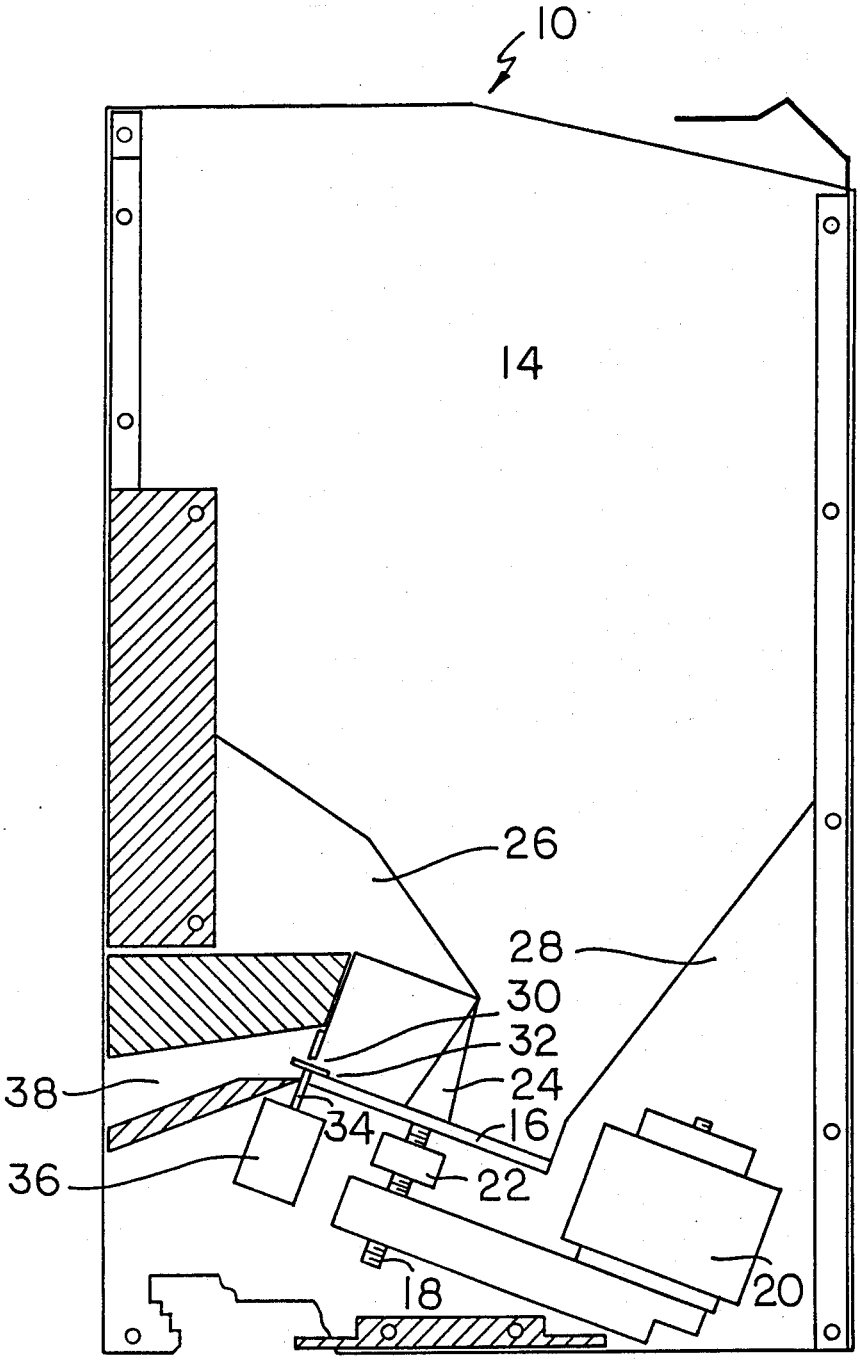
FIG. 1 is a cross-sectional schematic view of a bulk hopper according to the invention.

Referring now to the drawings and more particularly FIG. 1, it can be seen that a bulk coin hopper according to the invention is designated generally by the numeral 10. The hopper 10 includes a housing or casing 12 which defines a bulk chamber 14. The chamber 14 is adapted for receiving coins, tokens or the like, to be paid-out in return for a valid piece of currency. Typically, the chamber 14 would house only coins of the same denomination, for example, quarters, dimes, nickels, or correspondingly identical tokens. Systems requiring the dispensing of multiple sizes of coins would simply employ a corresponding plurality of bulk hoppers 10.

Positioned at the bottom of the chamber 14 is a coin rotor 16 which is preferably a metallic disk maintained upon a shaft 18. The shaft 18 is caused to rotate by selective actuation of a motor 20, connected to the shaft 18 through a coupler 22. Extending normally upward from the plate or disk 16 is a cone 24 having its apex away from the disk 16 and its base received thereon.

It will be observed that the chamber 14 is substantially vertical and that the plate 16 is maintained at an angle at the bottom thereof. The disk 16 is typically maintained at an angle of 15°–45°, and preferably 30°. The disk 16 is maintained on such an angle to assist in feeding coins from the chamber 14 to the disk 16 and to also reduce the loadweight of the coins upon the disk 16 such that a smaller motor 20 may be used to obtain the desired rotation thereof. As shown, side plates 26,28 are adapted as a part of the housing 12 to direct the coins on to the plate 16. It will also be appreciated that the cone 24 prevents the coins from transverse movement across the face of the plate 16, requiring that the coins engage in circular movement about the rotating disk 16, thereby assisting in the dispensing of the coins in a manner which will become apparent hereinafter.

As shown, a dispensing slot 30 is maintained in the housing 12 and in communication with the circumferential edge of the disk 16. Maintained at such dispensing slot 30 is a dispensing disk 32 which is parallel to the disk 16. The disk 32 is caused to rotate by the shaft 34, parallel to the shaft 18, which is in turn connected to the motor 36. The motor 36 is adapted for selective actuation along with the motor 20. As shown, the dispensing slot 30 communicates with the dispensing passage 38 through the housing 12 and to a bowl or other appropriate receptacle into which the dispensed coins will be deposited.

Figure 2:
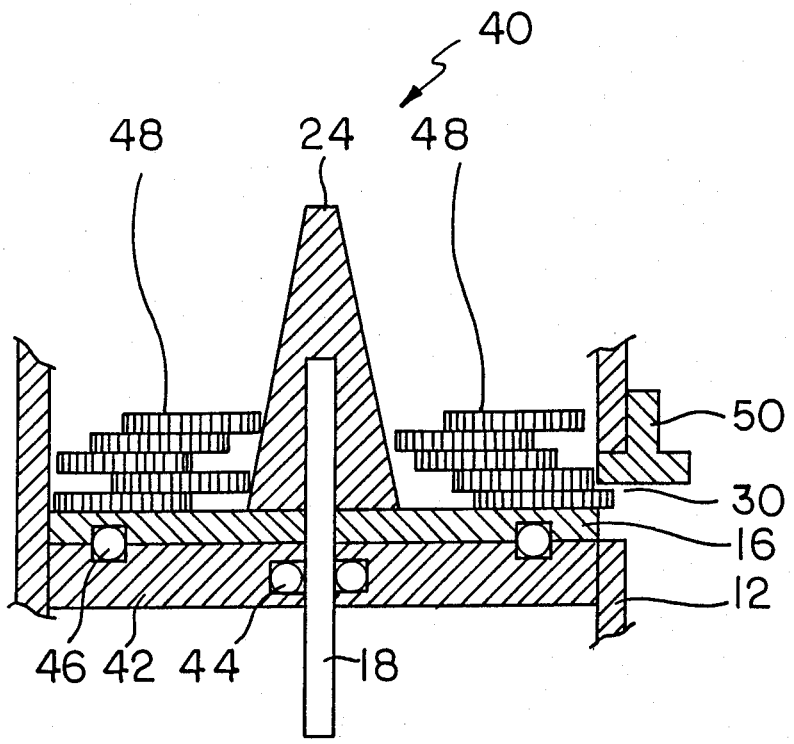
FIG. 2 is a cross-sectional schematic of the coin rotor assembly of the bulk hopper of the invention showing the exit slots.

With reference now to FIG. 2 a schematic view of the coin rotor assembly 40 of the invention may be seen. As shown, a stationary base plate 42 is appropriately secured to the housing 12 and receives therein a main bearings 44 for rotational receipt and support of the shaft 18. Thrust bearings 46 are also received by the base plate 42 upon which the disk 16 may rotate. As shown, a plurality of coins 48 fall upon the disk 16 and are then positioned for ejectment through the dispensing slot 30 in a manner to be discussed later. An appropriate shim or the like 50 may be positioned at the slot 30 to appropriately define the height of the slot. It will also be appreciated that the element 50 may comprise a reflective photo detector or the like for sensing the ejecting of one of the coins 48 through the slot 30 and signaling a counter of such event so that the total number of coins ejected can be determined.

Figure 3:
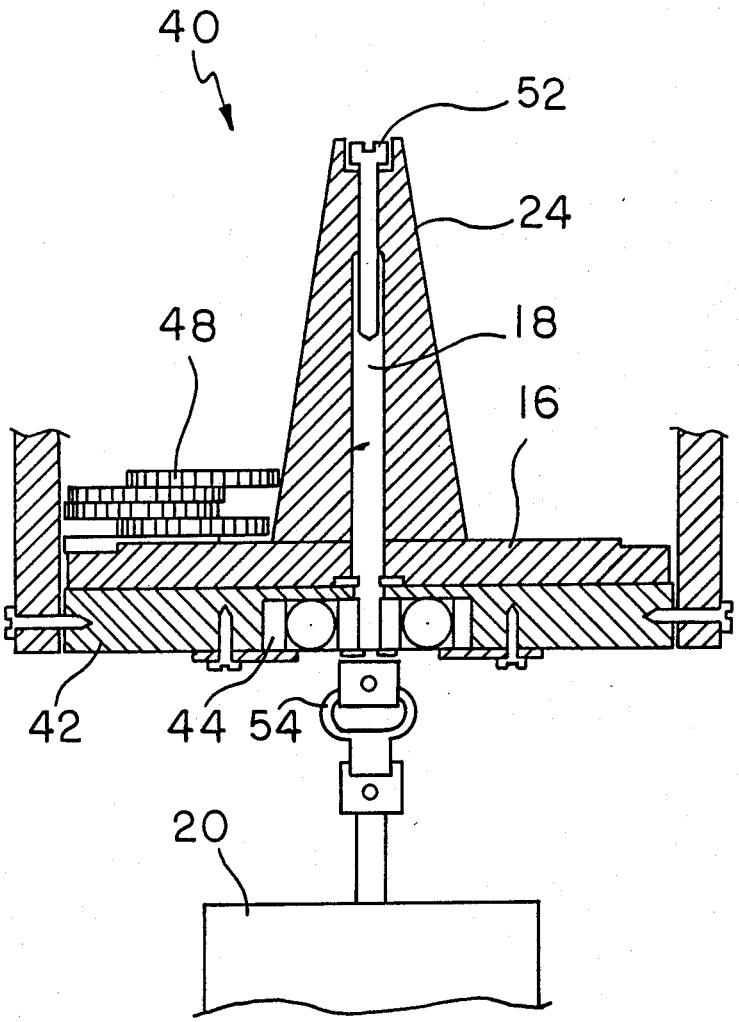
FIG. 3 is a cross-sectional schematic view of the coin rotor assembly of the bulk hopper of the invention showing securement of the coin cone.

As shown in FIG. 3, the coin cone 24 is secured to the shaft 18 by threaded engagement of the screw 52 to the shaft. As further shown in this illustrative drawing, the interconnection between the rotor end gear box 20 and the shaft 18 may be by means of an elastomeric coupling 54.

An appreciation and understanding of the coin rotor 16 and its association with the dispensing disk 32 may best be had with reference to FIGS. 4 and 5. As shown, the disk 16 is characterized by a plurality of receptacles or lands 56 which are simply housed-out areas on the top face of the disk 16 with sufficient size to receive an appropriate one of the coins 48. The width of the land or receptacle 56 is, accordingly, dependant upon the coins to be deposited in the chamber 14. The depth of the lands or grooves 56 are tyically 0.150–0.250 inch, and most preferably on the order of 0.180 inch, which has been found to be suitable for receiving nickels and quarters. Obviously, the lands 56 can be shallower for the receipt of dimes. As best shown in FIGS. 5*a* and 5*b* a circumferential groove 58 is positioned about the disk 16 for receipt of the dispensing disk 32. As shown, there is a slight tangential overlap between the large coin rotor or disk 16 and the smaller dispensing disk 32. In any event, it is preferred that the circumferential groove 58 engage with the lands 56 and share a common bottom surface such that the dispensing disk 32 will communicate with the lands 56. It is, or course, contemplated that a circumferential edge of the disk 16 may be removed or rabbeted to the depth of the lands 56 for receipt of the disk 32, rather than providing a groove in the circumferential edge of the disk 16 for receipt of the disk 32.

It will be observed that the coin rotor 16 is caused to rotate in a clockwise direction, as is the dispensing disk 32. Accordingly, there is a bite of sorts developed at the point of overlap between the two disks to assist in the ejecting of coins received within the lands 56 through the dispensing slot 30.

In operation, when a piece of currency is tested and determined to be valid, the rotors 20,36 begin to rotate. Coins contained in the chamber 14 are directed by the side plates 26,28 onto the rotating disk 16 and, by virtue of the presence of the cone 24, are urged into the receptacles or lands 56. As the disk 16 rotates coins in the lands are urged outwardly by centrifugal force toward the dispensing disk 32. The rotating disk 32 contacts the coins and quickly ejects them through the slot 30. The rearward edge of the land 56 assists in such ejectment and prevents the return of the coin 48 through the chamber 14 of the bulk hopper. If the coin is ejected, reflective photo detector 50 senses its passing and indicates the same to a counter which, upon determining that a full complement has been dispensed, terminates operation of the motors 20,36.

It has been found in a preferred embodiment of the invention that the coin rotor operates at 100–150 RPM, and preferably 120 RPM. Further, the diameter of the plate 16 should be on the order of 3–4 inches and preferably 3.5 inch. In like manner, it has been found that the dispensing disk 32 should have a diameter of 0.4–0.7 inch and most preferably 0.5 inch. Rotational speed of the dispensing disk 32 is preferably on the order of 4,000–5,000 RPM and most preferably 4,500 RPM. Using these parameters, a bulk hopper manufactured according to the instant invention is found to be capable of dispensing 480 coins per minute, at an efficiency rate of 92%. In other words, 92% of the lands 56 passing the slot 30 have a coin therein which is ejected by means of the dispensing wheel 32.

Thus it can be seen that the objects of the invention have been satisfied by the structure presented hereinabove. While in accordance with the patent statutes, only the best mode and preferred embodiment of the invention has been presented and described in detail, it is to be understood that the invention is not limited thereto or thereby. Accordingly, for an appreciation of the true scope and breath of the invention, reference should be had to the following claims.

What is claimed is:

1. A bulk hopper for a coin dispenser comprising:

a chamber defined by a housing for receiving coins in bulk, said chamber have a bottom;

a first circular disk maintained at said bottom of said chamber, said first circular disk being selectively adapted for rotation and characterized by a receptacle therein for receiving one of said coins, said receptacle comprising a groove communicating with an external edge of said first circular disk, said housing having a slot therein in communication with said groove at said external edge of said first circular disk; and a second circular disk received within said slot, said second circular disk selectively rotatable within said slot, said first and second circular disks rotating in the same direction, said second circular disk being received within a circumferential groove of said first circular disk.

2. The bulk hopper according to claim 1 wherein said chamber is vertical and wherein said first circular disk is maintained at said bottom of said chamber at an angle.

3. The bulk hopper according to claim 2 wherein said first circular disk is angled upwardly from the horizontal 15°–45°.

4. The bulk hopper according to claim 3 wherein said first and second circular disks are parallel to each other.

5. A hopper for a changer, comprising:

a chamber for receiving coins in bulk, said chamber defined by a housing, said housing having a slot opening therein;

a first disk maintained at a bottom of said chamber and adapted for selective rotation, said first disk passing in juxtaposition to said slot opening in said housing; and a second disk maintained at said slot opening and rotatable therein, said first and second disks being parallel to each other and rotating in the same direction about parallel axes.

6. The hopper as recited in claim 5 wherein said first disk has grooves in a top surface thereof for receiving coins therein, said grooves communicating with a circumferential edge of said first disk.

7. The hopper as recited in claim 6 wherein said circumferential edge has a circumferential slot thereabout, said circumferential slot receiving said second disk.

8. The hopper as recited in claim 6 wherein said grooves are of a depth of 0.150-0.250 inch.

9. The hopper as recited in claim 6 wherein said circumferential edge is rabbeted to receive said second disk.

10. The hopper as recited in claim 9 wherein said circumferential edge is rabbeted to a bottom surface of said grooves.

* * * * *